US007254890B2

(12) United States Patent
Barnes et al.

(10) Patent No.: US 7,254,890 B2
(45) Date of Patent: Aug. 14, 2007

(54) METHOD OF MAKING A MICROFLUID EJECTION HEAD STRUCTURE

(75) Inventors: Johnathan L. Barnes, Richmond, KY (US); Craig M. Bertelsen, Union, KY (US); Brian C. Hart, Georgetown, KY (US); Gary R. Williams, Lexington, KY (US); Sean T. Weaver, Union, KY (US); Girish S. Patil, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 363 days.

(21) Appl. No.: 11/026,504

(22) Filed: Dec. 30, 2004

(65) Prior Publication Data

US 2006/0146092 A1 Jul. 6, 2006

(51) Int. Cl.
*B21D 53/76* (2006.01)
*B41J 2/04* (2006.01)

(52) U.S. Cl. ..... 29/890.1; 29/413; 29/417; 29/835; 29/837; 29/838; 347/54

(58) Field of Classification Search ..... 29/890.1, 29/413, 417, 835, 837, 838; 347/54, 47, 347/68, 69, 75, 76, 78; 216/27.2; 427/154, 427/155, 156, 256, 421.1, 421.7; 438/21
See application file for complete search history.

(56) References Cited

U.S. PATENT DOCUMENTS 4,450,455 A 5/1984 Sugitani et al.
4,558,333 A 12/1985 Sugitani et al.
5,331,344 A 7/1994 Miyagawa et al.
5,420,623 A 5/1995 Tamura
5,458,254 A 10/1995 Miyagawa et al.
5,478,606 A 12/1995 Ohkuma et al.
5,578,417 A 11/1996 Noguchi et al.
5,983,486 A 11/1999 Shimomura et al.
6,022,482 A * 2/2000 Chen et al. ..... 216/27
6,022,752 A * 2/2000 Hirsh et al. ..... 438/21
6,033,581 A * 3/2000 Kobayashi ..... 216/27
6,041,501 A * 3/2000 Suzuki et al. ..... 29/890.1
6,139,761 A * 10/2000 Ohkuma ..... 216/27
6,145,965 A 11/2000 Inada et al.
6,310,641 B1 10/2001 Mrvos et al.
6,409,312 B1 6/2002 Mrvos et al.

FOREIGN PATENT DOCUMENTS

JP 2000-177139 6/2000

* cited by examiner

*Primary Examiner*—A. Dexter Tugbang
*Assistant Examiner*—Tai Van Nguyen
(74) *Attorney, Agent, or Firm*—Luedeka, Neely & Graham, PC

(57) ABSTRACT

A method of making a micro-fluid ejection head structure for a micro-fluid ejection device. The method includes applying a removable mandrel material to a semiconductor substrate wafer containing fluid ejection actuators on a device surface thereof. The mandrel material is shaped to provide fluid chamber and fluid channel locations on the substrate wafer. A micro machinable material is applied to the shaped mandrel and the device surface of the wafer to provide a nozzle plate and flow feature layer on the shaped mandrel and wafer. A plurality of nozzle holes are formed in the nozzle plate and flow feature layer. The shaped mandrel material is then removed from the device surface of the substrate wafer to provide fluid chambers and fluid channels in the nozzle plate and flow feature layer.

18 Claims, 6 Drawing Sheets

36
54
34

36
54
38
34
56

36
54
60
38
34

62
38
34
36

66
T1
64
62
38
34
36

52
64
62
38
34
36

52
44
46
48
50
38
34
36

36
54
34

54
70
34
36

72
34
36

54
38
34
36
74

66
64
72
38
34
36

52
64
72
38
34
36

52
44
46
48
50
38
34
36

36
54
34

36
54
38
34
56

54
80
34
38
36

86
84
T2
82
T3
34
38
36
74

90
88
84
34
38
36

92
88
84
34
38
36

94
92
96
98
100
34
38
36

36
54
34

54
104
34
36

106
54
34
36
74

106
38
34
36
74

90
88
106
38
34
36

92
106
88
38
34
36

94
92
96
98
100
38
34
36

METHOD OF MAKING A MICROFLUID EJECTION HEAD STRUCTURE

This application is related to co-owned U.S. patent application Ser. No. 10/937,968, entitled "Process for Making a Micro-fluid Ejection Head Structure," filed on Sep. 10, 2004.

FIELD

The disclosure relates to micro-fluid ejection devices, and in particular to improved methods for making micro-fluid ejection head structures

BACKGROUND

Micro-fluid ejection heads are useful for ejecting a variety of fluids including inks, cooling fluids, pharmaceuticals, lubricants and the like. A widely used micro-fluid ejection head is in an ink jet printer. Ink jet printers continue to be improved as the technology for making the micro-fluid ejection heads continues to advance. New techniques are constantly being developed to provide low cost, highly reliable printers which approach the speed and quality of laser printers. An added benefit of ink jet printers is that color images can be produced at a fraction of the cost of laser printers with as good or better quality than laser printers. All of the foregoing benefits exhibited by ink jet printers have also increased the competitiveness of suppliers to provide comparable printers in a more cost efficient manner than their competitors.

One area of improvement in the printers is in the print engine or micro-fluid ejection head itself. This seemingly simple device is a relatively complicated structure containing electrical circuits, ink passageways and a variety of tiny parts assembled with precision to provide a powerful, yet versatile micro-fluid ejection head. The components of the ejection head must cooperate with each other and with a variety of ink formulations to provide the desired print properties. Accordingly, it is important to match the ejection head components to the ink and the duty cycle demanded by the printer. Slight variations in production quality can have a tremendous influence on the product yield and resulting printer performance.

The primary components of a micro-fluid ejection head are a semiconductor substrate, a nozzle plate and a flexible circuit attached to the substrate. The semiconductor substrate can be made of silicon and contains various passivation layers, conductive metal layers, resistive layers, insulative layers and protective layers deposited on a device surface thereof Fluid ejection actuators formed on the device surface may be thermal actuators or piezoelectric actuators. For thermal actuators, individual heater resistors are defined in the resistive layers and each heater resistor corresponds to a nozzle hole in the nozzle plate for heating and ejecting fluid from the ejection head toward a desired substrate or target.

The nozzle plates typically contain hundreds of microscopic nozzle holes for ejecting fluid therefrom. A plurality of nozzle plates are usually fabricated in a polymeric film using laser ablation or other micro-machining techniques. Individual nozzle plates are excised from the film, aligned, and attached to the substrates on a multi-chip wafer using an adhesive so that the nozzle holes align with the heater resistors. The process of forming, aligning, and attaching the nozzle plates to the substrates is a relatively time consuming process and requires specialized equipment.

Fluid chambers and ink feed channels for directing fluid to each of the ejection actuator devices on the semiconductor chip are either formed in the nozzle plate material or in a separate thick film layer. In a center feed design for a top-shooter type micro-fluid ejection head, fluid is supplied to the fluid channels and fluid chambers from a slot or ink via which is formed by chemically etching, dry etching, or grit blasting through the thickness of the semiconductor substrate. The substrate, nozzle plate and flexible circuit assembly is typically bonded to a thermoplastic body using a heat curable and/or radiation curable adhesive to provide a micro-fluid ejection head structure.

In order to decrease the cost and increase the production rate of micro-fluid ejection heads, newer manufacturing techniques using less expensive equipment is desirable. These techniques, however, must be able to produce ejection heads suitable for the increased quality and speed demanded by consumers. Thus, there continues to be a need for manufacturing processes and techniques which provide improved micro-fluid ejection head components.

SUMMARY OF THE EMBODIMENTS

The disclosure provides a method of making a micro-fluid ejection head structure. The method includes applying a removable mandrel material to a semiconductor substrate wafer containing fluid ejection actuators on a device surface thereof. The mandrel material is shaped to provide fluid chamber and fluid channel locations on the semiconductor substrate wafer. A micro machinable material is applied to the shaped mandrel and the device surface of the substrate wafer to provide a nozzle plate and flow feature layer on the shaped mandrel and device surface. The nozzle plate and flow feature layer having a thickness ranging from about 10 to about 80 microns. A plurality of nozzle holes are formed in the nozzle plate and flow feature layer. Then the shaped mandrel material is removed from the device surface of the substrate wafer to provide fluid chambers and fluid channels in the nozzle plate and flow feature layer.

In another embodiment there is provided a method of making a micro-fluid ejection head structure. The method includes forming a plurality of fluid supply slots in a semiconductor substrate wafer having a device surface thereon. A removable mandrel material is applied to the device surface of the semiconductor substrate wafer. The mandrel material is shaped to provide fluid chamber and fluid channel locations on the semiconductor substrate wafer. A micro-machinable material is dry-sprayed onto the shaped mandrel material and the device surface of the substrate wafer using a carrier fluid to provide a spray-coated layer on the shaped mandrel and device surface of the substrate wafer. The spray-coated layer has a thickness ranging from about 10 to about 80 microns. A plurality of nozzle holes are formed in the spray-coated layer. The shaped mandrel material is then removed from the device surface of the substrate wafer to provide fluid chambers and fluid channels in the spray-coated layer.

In yet another embodiment, there is provided a micro-fluid ejection head structure. The structure includes a semiconductor substrate having at least one fluid supply slot formed therein and containing a plurality of fluid ejection actuators on a device surface thereof adjacent at least one edge of the fluid supply slot. A dry-sprayed layer is provided on the device surface of the substrate. The dry-sprayed layer includes a plurality of nozzle holes and corresponding fluid chambers and fluid supply channels therein. Each of the nozzle holes are in fluid flow communication with one of the fluid chambers and one of the fluid supply channels for fluid flow communication with the fluid supply slot. Each of the nozzle holes is also associated with one of the fluid ejection actuators.

An advantage of at least some of the embodiments described herein is that they can provide an improved micro-fluid ejection head structure and method for making the micro-fluid ejection head structure so as to avoid forming then attaching individual nozzle plates to a semiconductor substrate. Accordingly, the entire process may be conducted during wafer processing using a minimum of process steps. Furthermore, the structure avoids the need to use more than one material attached to the substrate wafer to provide the nozzle holes, fluid chambers, and fluid supply channels required for ejecting fluid from the structure. Because the nozzle plate attaching step is avoided, alignment of the flow features in the nozzle plate with the ink ejection devices on the semiconductor substrate is greatly improved. Delamination problems between the nozzle plate and underlying flow feature layer are also eliminated. Unlike spin-coating techniques used to apply photoresist materials to a wafer before fluid feed slots are formed in the substrates on the wafer, at least some of the embodiments of the disclosure provide techniques that can enable materials to be applied to the wafer before or after the fluid feed slots are formed in the substrates. Embodiments described herein can also enable production of micro-fluid ejection heads having variable nozzle plate and flow feature thicknesses without substantially affecting the planarity of the nozzle plate chip assembly.

BRIEF DESCRIPTION OF THE DRAWINGS

Further features and advantages of the disclosed embodiments will become apparent by reference to the detailed description when considered in conjunction with the figures, which are not to scale, wherein like reference numbers indicate like elements through the several views, and wherein.

DETAILED DESCRIPTION OF THE EMBODIMENTS

Micro-fluid ejection heads are typically manufactured using laser ablation techniques to form flow features and nozzle holes in a polymer film. Individual nozzle plates are excised from the polymer film, then aligned, and attached to semiconductor substrates on a substrate wafer. The process requires the use of expensive excimer laser equipment and pick-and-place nozzle plate attachment tools. Furthermore, individual nozzle plate placement is a relatively slow process since each nozzle plate must be separately made and aligned. For micro-fluid ejection heads having closer nozzle hole spacing for higher resolution printing, for example, alignment tolerances of the nozzle plates to the semiconductor substrates are not sufficient.

Figure 1:
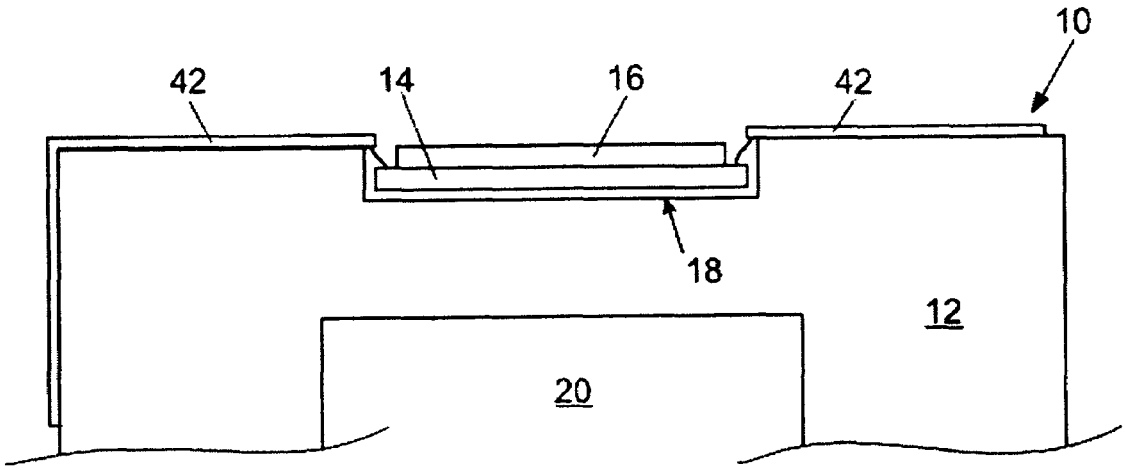
FIG. 1 is a cross-sectional view, not to scale, of a micro-fluid ejection head including a micro-fluid ejection head structure according to the disclosure.

With reference to FIG. 1, there is shown a simplified representation of a portion of a micro-fluid ejection head 10 viewed from a side thereof and attached to a fluid cartridge body 12. The ejection head 10 includes a semiconductor substrate 14 and a nozzle plate 16. The substrate/nozzle plate assembly 14/16 is attached in a chip pocket 18 in the cartridge body 12 to form the ejection head 10. Fluid to be ejected is supplied to the substrate/nozzle plate assembly 14/16 from a fluid reservoir 20 in the cartridge body 12 generally opposite the chip pocket 18.

The cartridge body 12 may be made of a metal or a polymeric material selected from the group consisting of amorphous thermoplastic polyetherimide available from G.E. Plastics of Huntersville, N.C. under the trade name ULTEM 1010, glass filled thermoplastic polyethylene terephthalate resin available from E. I. du Pont de Nemours and Company of Wilmington, Del. under the trade name RYNITE, syndiotactic polystyrene containing glass fiber available from Dow Chemical Company of Midland, Mich. under the trade name QUESTRA, polyphenylene oxide/high impact polystyrene resin blend available from G.E. Plastics under the trade names NORYL SE1 and polyamide/polyphenylene ether resin available from G.E. Plastics under the trade name NORYL GTX. An exemplary polymeric material for making the cartridge body 12 is NORYL SE1 polymer.

In a prior art process, prior to attaching the substrate 14 to the cartridge body 12, a laser ablated nozzle plate 21 is attached to a device side 22 of the substrate (FIG. 2) by use of one or more adhesives 24. The adhesive 24 used to attach the nozzle plate 21 to the substrate 14 can be a heat curable adhesive such as a B-stageable thermal cure resin, including, but not limited to phenolic resins, resorcinol resins, epoxy resins, ethylene-urea resins, furane resins, polyurethane resins and silicone resins. An exemplary adhesive 24 for attaching the nozzle plate 21 to the substrate 14 is a phenolic butyral adhesive which is cured using heat and pressure. The nozzle plate adhesive 24 can be cured before attaching the substrate/nozzle plate assembly 14/21 to the cartridge body 12.

Figure 2:
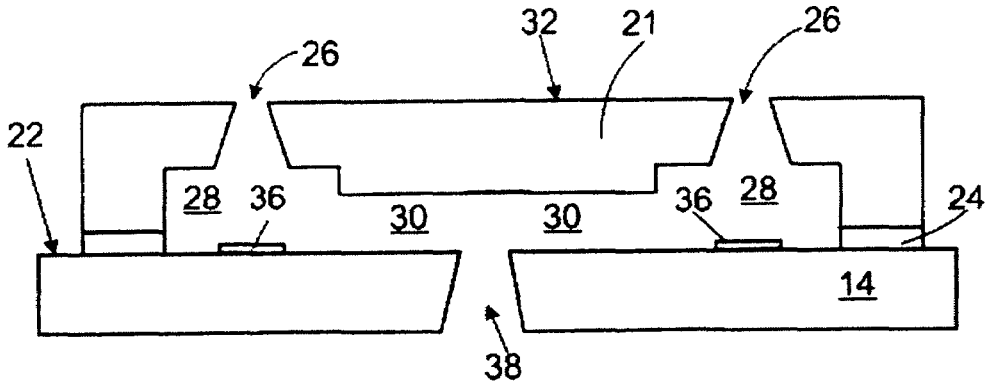
FIG. 2 Prior Art
FIG. 2 is cross-sectional views, not to scale, of a portion of a prior art micro-fluid ejection head structure.

As shown in detail in FIG. 2, a conventional nozzle plate 21 contains a plurality of the nozzle holes 26 each of which are in fluid flow communication with a fluid chamber 28 and a fluid supply channel 30. The fluid chamber 28 and fluid supply channel 30 are typically formed in the nozzle plate material from a side attached to the semiconductor substrate 14 as by laser ablation of the nozzle plate material. The fluid chambers 28 and fluid supply channels 30 are referred to collectively as "flow features." After laser ablating the nozzle plate 21, the nozzle plate 21 is washed to remove debris therefrom. Such nozzle plates 21 are typically made of polyimide which may contain an ink repellent coating on a surface 32 thereof. Nozzle plates 21 may be made from a continuous polyimide film containing the adhesive 24. In an exemplary embodiment, the film can be either about 25 or about 50 microns thick and the adhesive is about 12.5 microns thick. The thickness of the film is fixed by the manufacturer thereof. After forming flow features and nozzle holes 26 in the film for individual nozzle plates 21, the nozzle plates 21 are excised from the film.

Figure 3:
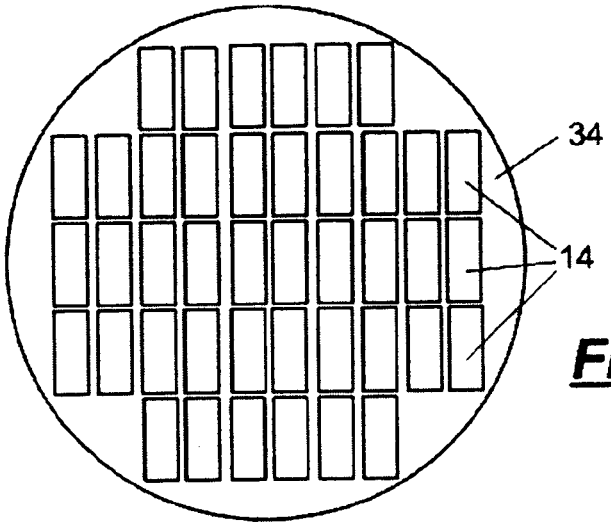
FIG. 3 is a plan view, not to scale, of a semiconductor wafer containing a plurality of semiconductor substrates.

The excised nozzle plates 21 are attached to a wafer 34 containing a plurality of semiconductor substrates 14 (FIG. 3). An automated device is used to optically align the nozzle holes 26 in each of the nozzle plates 21 with heater resistors 36 on the semiconductor substrates 14 and to attach the nozzle plates 21 to the semiconductor substrates 14. Misalignment between the nozzle holes 26 and the heater resistors 36 may cause problems such as misdirection of ink droplets from the ejection head 10, inadequate droplet volume or insufficient droplet velocity. The laser ablation equipment and automated nozzle plate attachment devices are costly to purchase and maintain. Furthermore it is often difficult to maintain manufacturing tolerances using such equipment in a high speed production process. Slight variations in the manufacture of each unassembled component are magnified significantly when coupled with machine alignment tolerances thereby decreasing the yield of micro-fluid ejection head assemblies.

In an exemplary embodiment, the semiconductor substrate 14 is a silicon semiconductor substrate 14 containing a plurality of fluid ejection actuators such as piezoelectric devices or heater resistors 36 formed on the device side 22 of the substrate 14 as shown in the simplified illustration of FIG. 2. Fluid ejection actuators, such as heater resistors 22, may be formed on a device side 28 of the semiconductor substrate 14 by well known semiconductor manufacturing techniques. Upon activation of heater resistors 36, fluid supplied through a fluid supply slot 38 in the semiconductor substrate 14 is caused to be ejected through nozzle holes 26 in nozzle plate 21.

The semiconductor substrates 14 are relatively small in size and typically have overall dimensions ranging from about 2 to about 8 millimeters wide by about 10 to about 20 millimeters long and from about 0.4 to about 0.8 mm thick. In conventional semiconductor substrates 14, the fluid supply slots 38 are grit-blasted in the semiconductor substrates 14. Such slots 38 typically have dimensions of about 9.7 millimeters long and 0.39 millimeters wide. Fluid may be provided to the fluid ejection actuators 36 by a single slot 38 or by a plurality of openings in the substrate 14 made by a dry etch process selected from reactive ion etching (RIE) or deep reactive ion etching (DRIE), inductively coupled plasma etching, and the like.

The fluid supply slots 38 direct fluid from the reservoir 20 of the cartridge body 12 (FIG. 1) through a passageway in the cartridge body 12 and through the fluid supply slots 38 in the semiconductor substrate 14 to the device side 22 of the substrate 14 containing heater resistors 36 (FIG. 2). The device side 22 of the substrate 14 can also comprise an electrical tracing from the heater resistors 36 to contact pads used for connecting the substrate 14 to a flexible circuit or a tape automated bonding (TAB) circuit 42 (FIG. 1) for supplying electrical impulses from a fluid ejection controller to activate one or more heater resistors 36 on the substrate 14.

Once high precision flow features and/or nozzle holes are formed in the nozzle plates 21, it would be disadvantageous for the features to be damaged during a fluid feed slot formation process for the semiconductor substrates 14. Thus, the material used for flow features and nozzle holes can be applied after the fluid feed slots are formed in the semiconductor substrates 14. However, forming the fluid feed slots in the substrates 14 before attaching the nozzle plates 21 to the substrates 14 creates several challenges. First, most wafer processing equipment (especially those with vacuum chucks) have difficulty handling wafers with holes. Secondly, material applied to wafers 34 containing through holes in a spin coating process may enter the holes causing hole, wafer backside, or equipment contamination. Thirdly, the material adjacent to and/or covering the holes may not be sufficiently uniform with the material on the rest of the wafer 34. For example, some material may slump into the hole, which adversely affects both the fluid chamber dimensions and the planarity of the nozzle plate 16 surface.

In order to circumvent the difficulties described above, the disclosure provides unique processes for making micro-fluid ejection heads using photoimageable techniques. In particular, the processes include the use of removable mandrels applied to a semiconductor substrate wafer before or after forming fluid feed slots in the individual substrates on the wafer. A conformal polymeric material is applied to the mandrel and the polymeric material is micro-machined to provide nozzle holes therein. Upon removal of the mandrel, fluid flow channels and fluid chambers are provided for fluid flow communication with the fluid feed slots in the substrates.

Figure 4A:
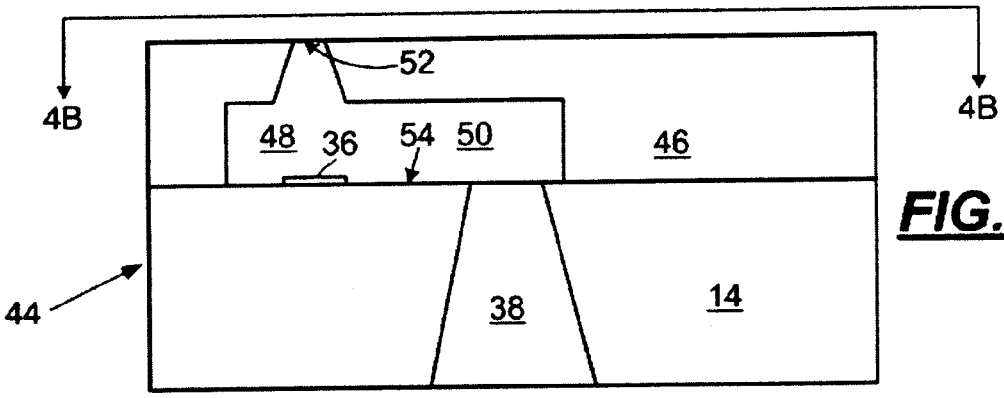
FIG. 4A is a cross-sectional view, not to scale of a portion of a micro-fluid ejection head structure according to the disclosure.
Figure 4B:
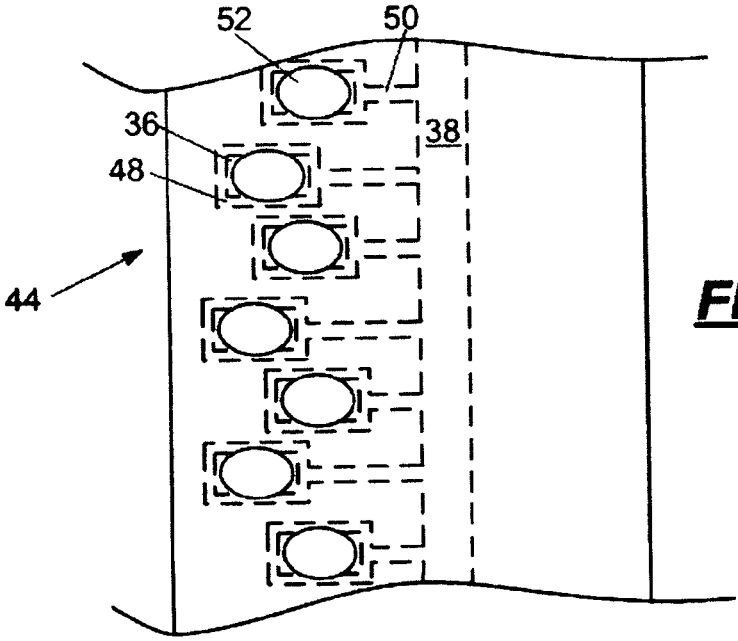
FIG. 4B is a plan view, not to scale, of a portion of a micro-fluid ejection head structure according to the disclosure.

A cross-sectional view, not to scale of a portion of a micro-fluid ejection head structure 44 according to one embodiment of the disclosure is illustrated in FIGS. 4A. A plan view of the structure 44 is illustrated in FIG. 4B. The structure 44 includes a polymeric layer 46 containing fluid chambers 48, fluid flow channels 50 and nozzle holes 52 that is attached to a device surface 54 of a semiconductor substrate 14.

A first process for making the micro-fluid ejection head structure 44 is illustrated schematically in 5A-5G. In a first step of the process (FIG. 5A) conductive, semiconductive, resistive, and insulative layers are formed on the device surface 54 of the substrate wafer 34 to provide the ejection devices 36 and electrical connections thereto.

Figures 5A, 5B, 5C, 5D, 5E, 5F, 5G:
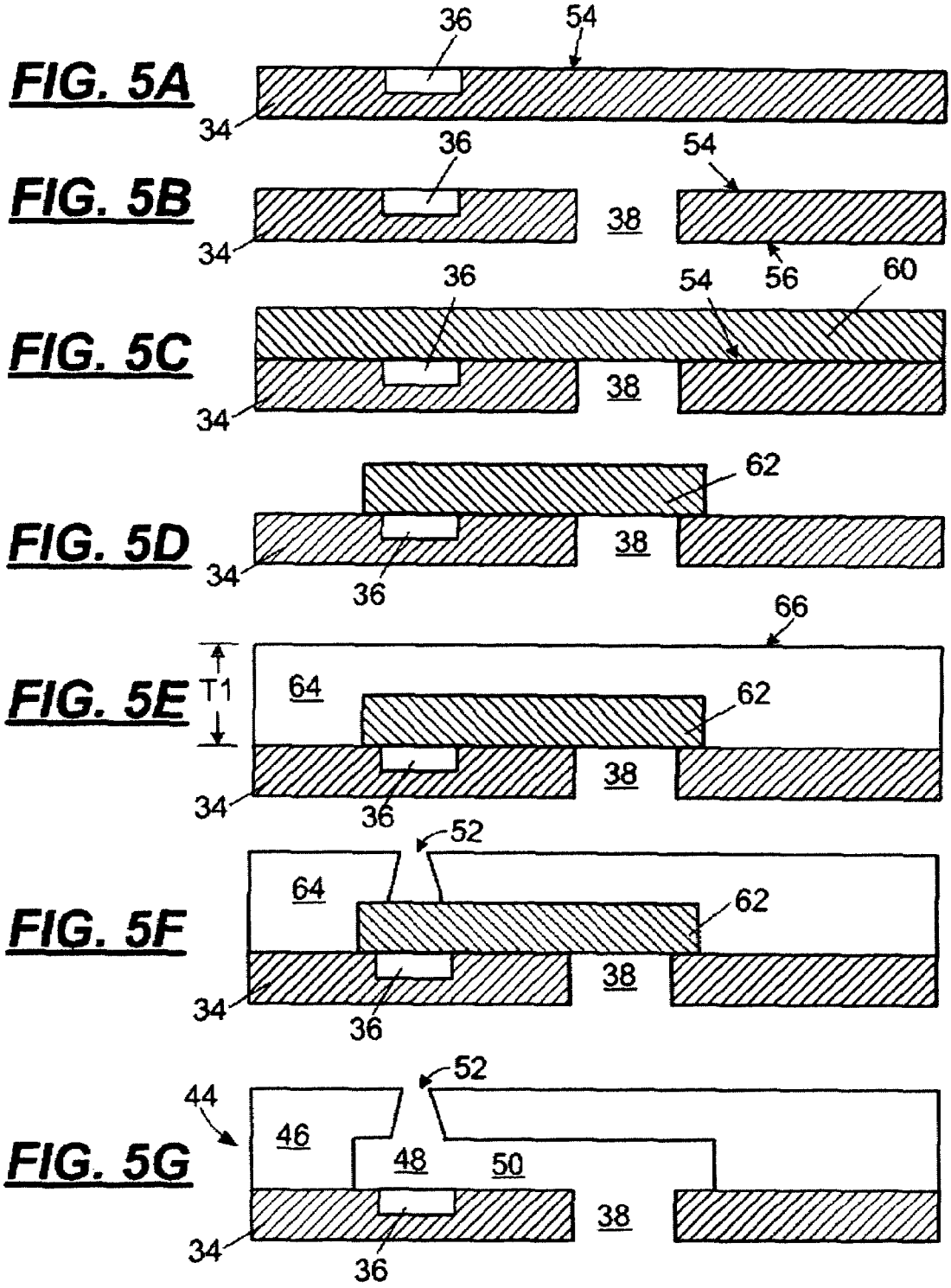
FIGS. 5A-5G are schematic views, not to scale, of steps in processes for making a micro-fluid ejection head structure according to a first embodiment of the disclosure.

Next, a plurality of fluid feed slots 38 are formed in the substrate wafer 34 as shown by FIG. 5B from the device side 54 or from a side 56 opposite the device side 54. The slots 38 may be formed using conventional techniques selected from the group consisting of dry etching, chemical wet etching, sand blasting, laser cutting, mechanical sawing, and combinations of two or more of the foregoing. An exemplary technique for forming slots 38 in the substrate wafer is a dry etching technique such as deep reactive ion etching (DRIE).

Once the slots 38 are formed in the substrate wafer 34, a dry film resist material 60 is applied to the device surface 54 of the substrate wafer 34 as shown in FIG. 5C. The dry film resist material 60 may be selected from a positive resist material or negative resist material, provided the resist material 60 is solvent strippable or otherwise removable from the substrate surface 54 after applying the polymeric layer that will contain the nozzles 52, fluid chambers 48 and fluid flow channels 50 to the resist material 60 and device surface 54 as described below. Exemplary materials might include epoxies, acrylates, novolacs, diazonaphthaquinone-based photoresists, diazonaphthaquinone class of photoresists, cyclized rubbers, and chemically amplified resists, with two specific exemplary materials including AZ P4620 from Clariant Corp. of Muttenz, Switzerland and SIPR 7121 from Shin-Etsu Chemical Co., Ltd. of Tokyo, Japan.

The dry film resist material 60 may be applied by laminating a dry film resist material 60 to the device surface 54 so that the resist material 60 applied to the surface 54 has a thickness ranging from about 10 to about 20 microns.

As shown in FIG. 5D, the dry film resist material 60 is then shaped to provide a mandrel 62 that upon removal from the device surface 54 of the substrate 34 will provide fluid channels and fluid chambers for the polymeric layer 46. The dry film resist material 60 may be imaged or ablated to form the mandrel 62 using conventional masking, photoimaging, and developing techniques typically used for photoresist materials.

After providing the mandrel 62, a micro-machinable material 64 is applied to the mandrel 62 and device surface 54 of the substrate 34 as shown in FIG. 5E. The micro-machinable material 64 may be applied to the mandrel 62 and device surface 54 by a dry spraying technique or by laminating a conformable polymeric material to the device surface 54 so that the micro-machinable material 64 has a substantially planar exposed surface 66 while covering the mandrel 62. An overall thickness T1 for the micro-machinable material ranges from about 15 to about 80 microns or more.

Suitable materials for the micro-machinable material 64 may include materials selected from the group consisting of epoxies, acrylates, polyimides, novolacs, diazonaphthaquinones, cyclized rubbers, chemically amplified resists, and the like. Positive or negative photoresist materials which may be used for the material 64 include, but are not limited to acrylic and epoxy-based photoresists such as the photoresist materials available from Clariant Corporation of Somerville, N.J. under the trade names AZ4620 and AZ1512. Other photoresist materials are available from Shell Chemical Company of Houston, Tex. under the trade name EPON SU8 and photoresist materials available Olin Hunt Specialty Products, Inc. which is a subsidiary of the Olin Corporation of West Paterson, N.J. under the trade name WAYCOAT. An exemplary photoresist material includes from about 10 to about 20 percent by weight difunctional epoxy compound, less than about 4.5 percent by weight multifunctional crosslinking epoxy compound, from about 1 to about 10 percent by weight photoinitiator capable of generating a cation and from about 20 to about 90 percent by weight non-photoreactive solvent as described in U.S. Pat. No. 5,907,333 to Patil et al., the disclosure of which is incorporated by reference herein as if fully set forth.

In order to dry-spray a polymeric material to provide the micro-machinable material 64 onto the mandrel 62 and device surface 54, a highly volatile carrier fluid is used. The carrier fluid may include a single volatile component or a mixture of volatile components. Suitable carrier fluids include but are not limited to toluene, xylene, methyl ethyl ketone, acetone, and mixtures thereof. For example a mixture of carrier fluid containing 80 weight percent methyl ethyl ketone and 20 weight percent acetophenone may be used. In an exemplary embodiment, the volatile carrier fluid can comprise from about 50 to about 97 percent by weight of the mixture of polymeric material and carrier fluid.

An exemplary mixture suitable for dry spraying the material 64 onto the mandrel 62 and surface 54 may include 9.3 percent by weight difunctional epoxy resin derived from diglycidal ether and bis-phenol-A available from Shell Chemical Company of Houston, Tex. under the trade name EPON 1007F, 2.0 percent by weight of a cationic photoinitiator containing a mixture of triarylsulfonium hexafluoroantimonate salts in propylene carbonate available from Union Carbide Corporation under the trade name CYRACURE UVI-6976, 0.2 percent by weight gamma-glycidoxypropyltrimethoxy-silane, 16.5 percent by weight acetophenone, and 72.0 percent by weight methyl ethyl ketone. The mixture may be dry-sprayed, using commercially available spray coating equipment such as the spray coating equipment available from the EV Group of Phoenix, Ariz. under the trade names EVG-101 and EVG-150.

During the dry-spraying step of the process, the polymeric material and carrier fluid are sprayed toward the mandrel 62 and surface 54 of the substrate wafer 34. As the mixture is sprayed, the liquid portion of the mixture, or carrier fluid, substantially evaporates before the mixture impacts on the surface 54 and/or mandrel 62 or shortly after the mixture impacts the surface 54 and/or mandrel 62 such that the mixture has insufficient fluid properties for the polymeric material to flow.

The micro-machinable material 64 may be a single layer or may include a plurality of layers provided by a plurality of dry-spraying steps. Prior to applying the material 64 to the device surface 54, the surface 54 may be treated with plasma or an adhesion promotion layer(s) such as silanes between Steps 5D and 5E to increase adhesion between the material 64 and the device surface 54.

Once the desired thickness of the micro-machinable material 64 is provided on the mandrel 62 and substrate wafer 34 surface 54, the material 64 may be imaged and developed using a mask and conventional photoimaging and developing techniques to provide the nozzle holes 52 therein as shown in FIG. 5F. The nozzle holes 52 may also be made in the material 64 using dry or wet etching techniques.

In an alternative process, a thin layer of the micro-machinable material 64 may be sprayed onto the device surface 54 of the substrate wafer 34 using the dry-spraying technique described above, followed by a wet spraying or spin-coating technique to provide the desired thickness of micro-machinable material 64.

Once the nozzle holes 52 are imaged in the material 64, the imaged material 64 and/or mandrel 62 may be developed using one or more solvents to provide the structure 44 shown in FIG. 5G. As shown in FIG. 5G, a single polymeric layer 46 contains the fluid chambers 48, fluid flow channels 50, and nozzle holes 52.

Suitable solvents include, but are not limited to, organic solvents such as butylcellosolve acetate, for example. In the alternative, only the imaged material 64 may be developed using a solvent and the mandrel 62 may be removed by an ashing technique whereby the mandrel 62 has a lower degradation temperature than the micro-machinable layer 64. For example, the mandrel 62 may be made of an epoxy photoresist material having a degradation temperature ranging from about 200° to about 250° C. Whereas the micro-machinable material 64 may be a photoresist material or a polyimide material having a degradation temperature of at least 300° C.

Figures 6A, 6B, 6C, 6D, 6E, 6F, 6G:
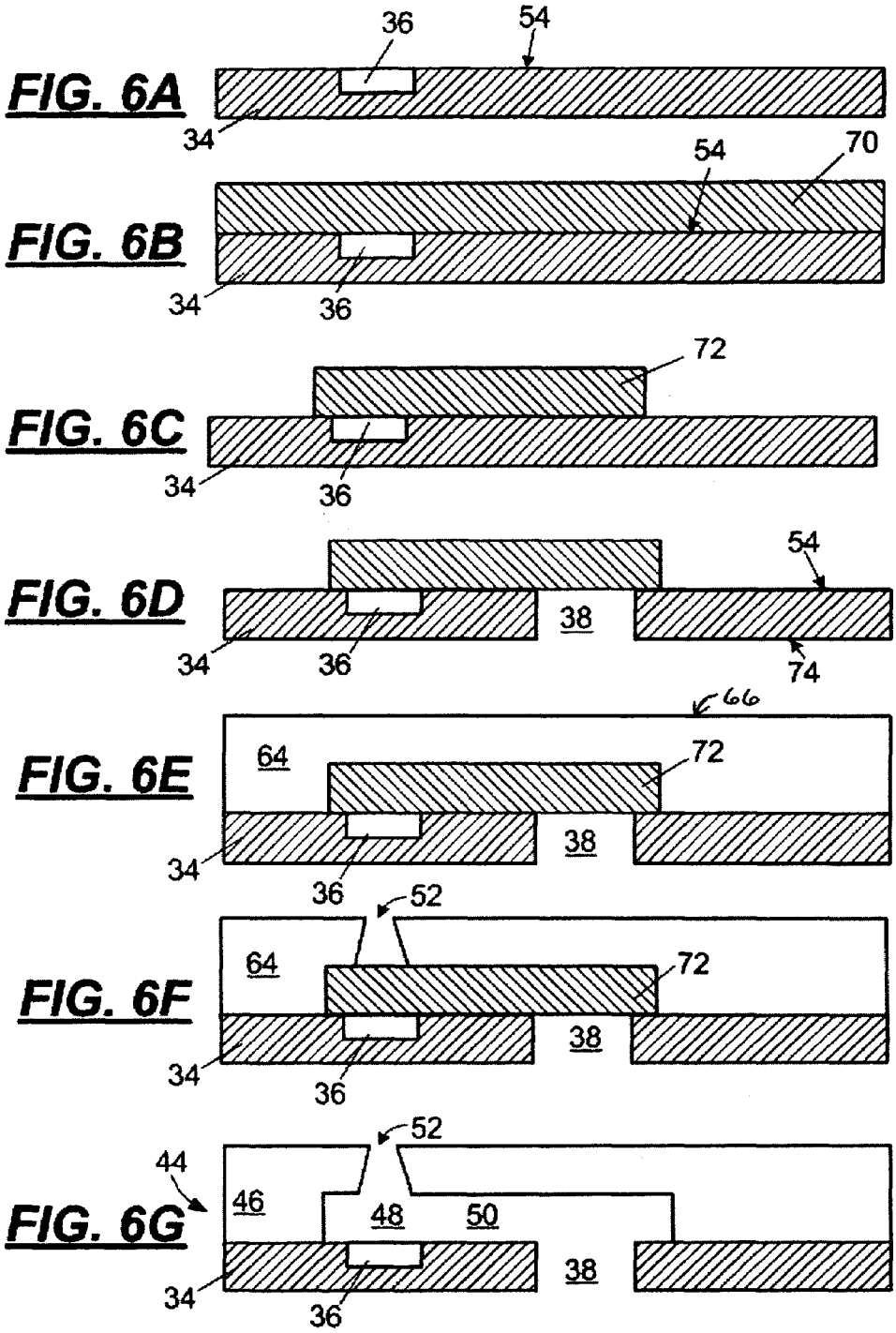
FIGS. 6A-6G are schematic views, not to scale, of steps in processes for making a micro-fluid ejection head structure according to a second embodiment of the disclosure.

FIGS. 6A-6G illustrate an alternative embodiment wherein a polymeric layer 70 providing a mandrel 72 may be applied to a substrate wafer 34 before forming the fluid feed slots 38 in the substrate wafer 34. Accordingly, a substrate wafer 34 containing the ejection devices 36 on a device surface 54 is provided (FIG. 6A) as described with respect to FIG. 5A. Next, the polymer layer 70 is applied to the device surface 54 of the substrate wafer 34 using as a dry film, as a dry-spray coated layer, or as a spin-coated layer as shown in FIG. 6B. Unlike the embodiment described above in FIG. 5B, the wafer 34 does not contain the slots 38, accordingly, the polymeric layer 70 may be applied as a wet layer, such as by spin-coating the substrate wafer 34 with the layer 70. The layer 70 is then imaged and developed to provide the mandrel 72 (FIG. 6C) generally as described above with respect to FIG. 5C.

After forming the mandrel 72, fluid supply slots 38 are formed though the substrate wafer 34 from a side 74 opposite the device side 54 as shown in FIG. 6D. In this embodiment, the mandrel 72 may act as an etch stop material for a dry or wet etching process used for forming the slots 38. Prior to forming the slots 38, a photoresist mask may be applied to the side 74 and a protective layer may be applied to the device side 54 and mandrel 72. The rest of the process is similar to the process described above with respect to FIGS. 5E-5G as shown schematically in FIGS. 6E-6G. Accordingly, FIGS. 5A-5G and 6A-6G provide processes for forming micro-fluid ejection head structures before or after forming fluid feed slots 38 in the substrate wafer 34.

Figures 7A, 7B, 7C, 7D, 7E, 7F, 7G:
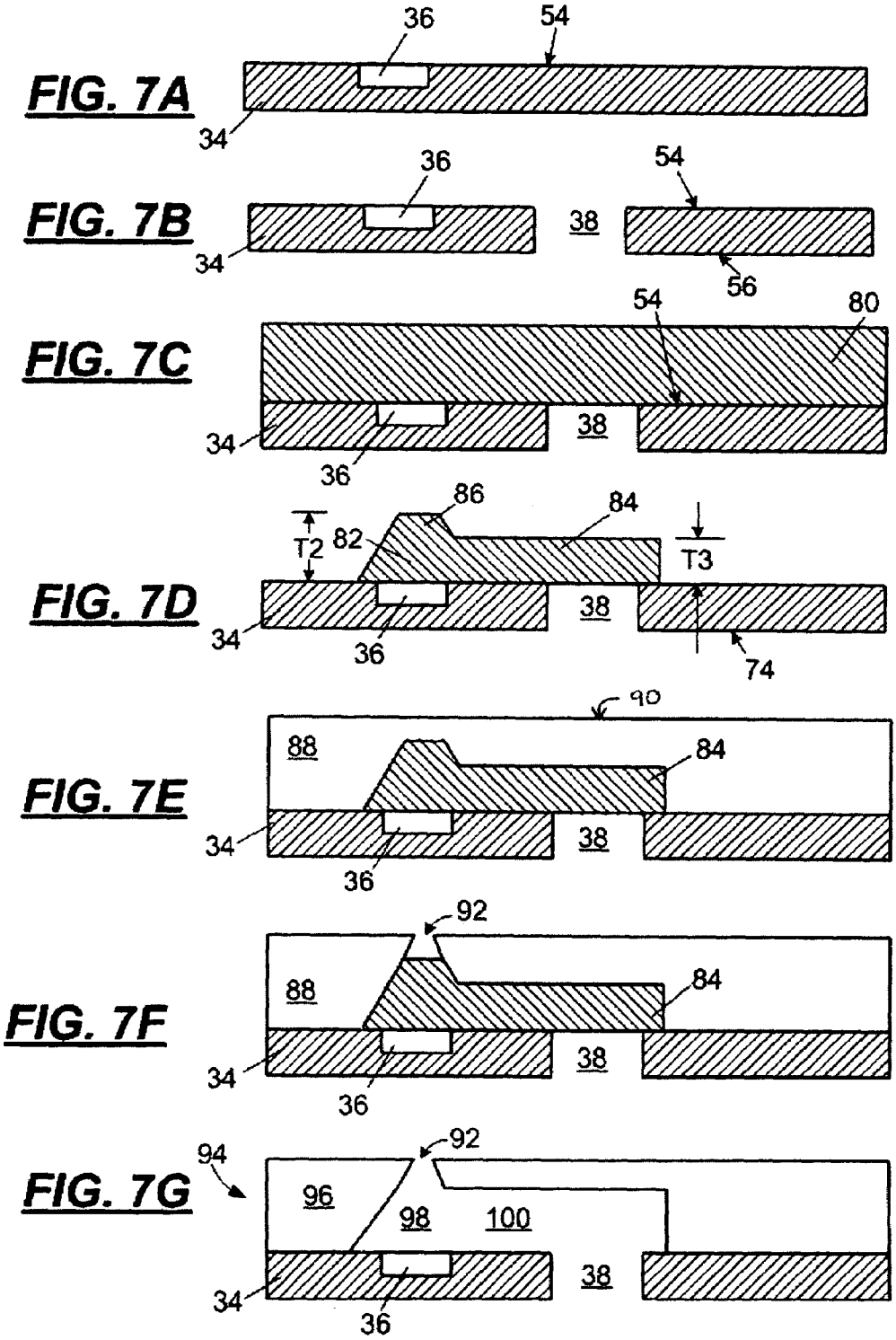
FIGS. 7A-7G are schematic views, not to scale, of steps in processes for making a micro-fluid ejection head structure according to a third embodiment of the disclosure.

Other embodiments of the disclosure are provided in FIGS. 7A-7G and 8A-8G which like FIGS. 5A-5G and 6A-6G are processes for forming micro-fluid ejection head structures 44 before or after forming fluid supply slots 38 in the substrate wafer 34. With reference to FIGS. 7A-7B the substrate wafer 34 is provided and fluid supply slots 38 are formed in the wafer as described above with reference to FIGS. 5A-5B.

Once the slots 38 are formed (see FIG. 7B) in the substrate wafer 34, a dry film resist material 80 is applied to the device surface 54 of the substrate wafer 34 as shown in FIG. 7C. As described above, the dry film resist material 80 may be selected from a positive resist material or negative resist material, provided the resist material 80 is solvent strippable or otherwise removable from the substrate surface 54 after applying the polymeric layer that will contain the nozzles 92, fluid chambers 98 and fluid flow channels 100 to the resist material 80 and device surface 54 as described below. The dry film resist material 80 may be applied by laminating a dry film resist material 80 to the device surface 54 so that the resist material 80 applied to the surface 54 has a thickness ranging from about 15 to about 35 microns. In the embodiments illustrated in FIGS. 7A-7G and 8A-8G, the resist material 80 is relatively thicker than the resist material 60 for the reasons set forth below.

As shown in FIG. 7D, the dry film resist material 80 is then shaped to provide a mandrel 82 that upon removal from the device surface 54 of the substrate 34 will provide fluid channels and fluid chambers for the polymeric layer 46. The dry film resist material 80 may be imaged or ablated to form the mandrel 82 using conventional masking, photoimaging, and developing techniques typically used for photoresist materials.

In one embodiment, the mandrel 82 is imaged using a gray scale mask or by varying the transmission rate of radiation during imaging to provide a multi-level mandrel having a first section 84 and a second section 86 as shown in FIG. 7D. Accordingly, the second section 86 may have a thickness T2 that is the same or slightly less than the thickness of the resist material 80 described above. The first section 84 may have a thickness T3 that ranges from about 30 to about 80 percent of the thickness T2. The foregoing technique of using two or more levels of transmissivity during photoimaging or varying other photoprocessing steps may permit fluid chambers to be made with geometries that reduce the chances of air bubbles getting trapped in corners of the fluid chambers.

After providing the mandrel 82, a micro-machinable material 88 is applied to the mandrel 82 and device surface 54 of the substrate 34 as shown in FIG. 7E. As with the embodiment described in FIG. 5E, the micro-machinable material 88 may be applied to the mandrel 82 and device surface 54 by a dry spraying technique or by laminating a conformable polymeric material to the device surface 54 so that the micro-machinable material 88 has a substantially planar exposed surface 90 while covering the mandrel 82.

As before, a micro-machinable material 88 may be dry-sprayed onto the mandrel 82 and surface 54 as a single layer or may include a plurality of layers provided by a plurality of dry-spraying steps. Once the desired thickness of the spray-coated material 88 is provided on the mandrel 82 and substrate wafer 34 surface 54, the material 88 may be imaged and developed using a mask and conventional photoimaging and developing techniques to provide the nozzle holes 92 therein as shown in FIG. 7F.

Once the nozzle holes 92 are imaged in the material 88, the imaged material 88 and/or mandrel 82 may be developed using one or more solvents as described above to provide the structure 94 shown in FIG. 7G. As shown in FIG. 7G, a single polymeric layer 96 contains the fluid chambers 98, fluid flow channels 100, and nozzle holes 92.

In the alternative, only the imaged material 88 may be developed using a solvent and the mandrel 82 may be removed by an ashing technique whereby the mandrel 82 has a lower degradation temperature than the micro-machinable layer 88. For example, the mandrel 82 may be made of an epoxy photoresist material having a degradation temperature ranging from about 200° to about 250° C. Whereas the micro-machinable material 88 may be a photoresist material or a polyimide material having a degradation temperature of at least 300° C.

Figures 8A, 8B, 8C, 8D, 8E, 8F, 8G:
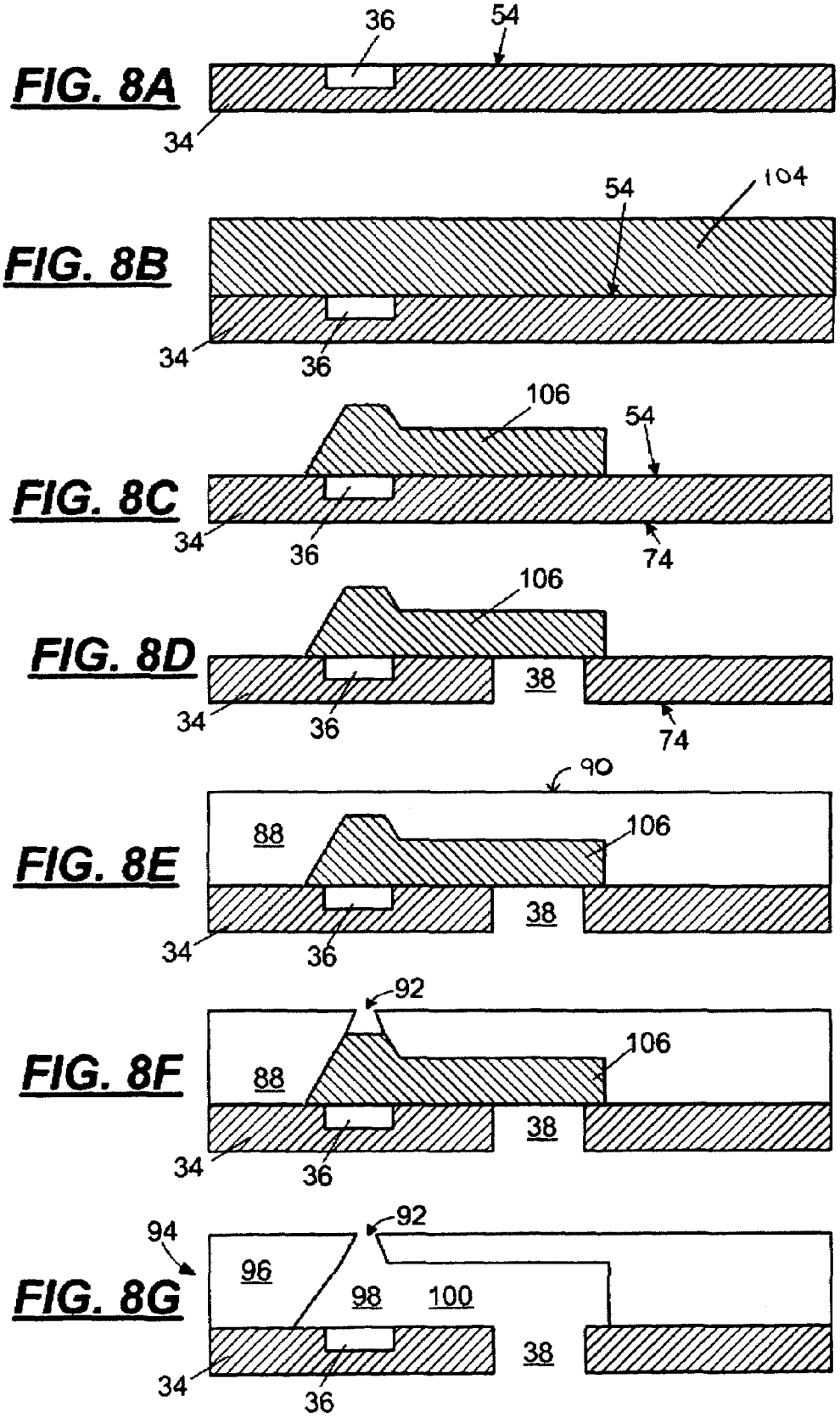
FIGS. 8A-8G are schematic views, not to scale, of steps in processes for making a micro-fluid ejection head structure according to a fourth embodiment of the disclosure.

FIGS. 8A-8G illustrate an alternative embodiment wherein a polymeric layer 104 providing a mandrel 106 may be applied to a substrate wafer 34 before forming the fluid feed slots 38 in the substrate wafer 34. Accordingly, a substrate wafer 34 containing the ejection devices 36 on a device surface 54 is provided (FIG. 8A) as described with respect to FIG. 5A. Next, the polymer layer 104 is applied to the device surface 54 of the substrate wafer 34 using as a dry film, as a dry-spray coated layer, or as a spin-coated layer as shown in FIG. 8B. Unlike the embodiment described above in FIG. 7B, the wafer 34 does not contain the slots 38, accordingly, the polymeric layer 104 may be applied as a wet layer, such as by spin-coating the substrate wafer 34 with the layer 104. The layer 104 is then imaged and developed to provide the mandrel 106 (FIG. 8C) generally as described above with respect to FIG. 7C.

After forming the mandrel 106, fluid supply slots 38 are formed though the substrate wafer 34 from a side 74 opposite the device side 54 as shown in FIG. 8D. In this embodiment, the mandrel 106 may act as-an etch stop material for a dry or wet etching process used for forming the slots 38. Prior to forming the slots 38, a photoresist mask may be applied to the side 74 and a protective layer may be applied to the device side 54 and mandrel 106. The rest of the process is similar to the process described above with respect to FIGS. 7E-7G as shown schematically in FIGS. 8E-8G. Accordingly, FIGS. 7A-7G and 8A-8G provide processes for forming micro-fluid ejection head structures before or after forming fluid feed slots 38 in the substrate wafer 34.

In all of the embodiments described above, contact pad openings and streets for dicing individual mirco-fluid ejection head structures 44 or 94 from the substrate wafer 34 may be provided in the layer 46 or 96 during the imaging and developing steps described above.

After forming the structures 44 or 94 described above on the wafer 34, individual nozzle plates/substrate assemblies may be excised from the semiconductor wafer 34 containing a plurality of nozzle plate/substrate assemblies. Each nozzle plate/substrate assembly is then electrically connected to the flexible circuit or TAB circuit 42 (FIG. 1) and the nozzle plate/substrate assembly is attached to the cartridge body 12 using a die attach adhesive. The nozzle plate/substrate assembly can be attached to the cartridge body 12 in the chip pocket 18 as described above with reference to FIG. 1. In an exemplary embodiment, the die attach adhesive seals around the edges of the semiconductor substrate 14 to provide a liquid tight seal to inhibit ink from flowing between edges of the substrate 14 and the chip pocket 18.

The die attach adhesive used to attach nozzle plate/substrate assembly to the cartridge body 12 can be an epoxy adhesive such as a die attach adhesive available from Emerson & Cuming of Monroe Township, New Jersey under the trade name ECCOBOND 3193-17. In the case of a nozzle plate/substrate assembly that requires a thermally conductive cartridge body 12, the die attach adhesive can be a resin filled with thermal conductivity enhancers such as silver or boron nitride. An exemplary thermally conductive die attach adhesive is POLY-SOLDER LT available from Alpha Metals of Cranston, R.I. A suitable die attach adhesive containing boron nitride fillers is available from Bryte Technologies of San Jose, Calif. under the trade designation G0063. In an exemplary embodiment, the thickness of adhesive ranges from about 25 microns to about 125 microns. Heat is typically required to cure the die attach adhesive and fixedly attach the nozzle plate/substrate assembly to the cartridge body 12.

Once the nozzle plate/substrate assembly is attached to the cartridge body 12, the flexible circuit or TAB circuit 42 is attached to the cartridge body 12 as by use of a heat activated or pressure sensitive adhesive. Exemplary pressure sensitive adhesives include, but are not limited to phenolic butyral adhesives, acrylic based pressure sensitive adhesives such as AEROSET 1848 available from Ashland Chemicals of Ashland, Ky. and phenolic blend adhesives such as SCOTCH WELD 583 available from 3M Corporation of St. Paul, Minn. In an exemplary embodiment, the pressure sensitive adhesive has a thickness ranging from about 25 to about 200 microns.

It will be appreciated that spray-coating techniques as described above may reduce the time needed to make micro-fluid ejection head structures 44 or 94 by enabling wafer level processing of multiple structures at one time. As the wafer sizes increase to provide more structures 44 or 94, the process time savings may be even larger.

Unlike laminated materials, spray-coated layers more readily conform to the surface 54 of the substrate wafer 34 which can improve adhesion between the wafer 34 and the layer 46 or 96. Improved adhesion reduces delamination problems which have occurred with conventional processes and laminated materials. The spray-coating techniques described herein may also provide better planarization of the surface 66 or 90 of the material 64 or 88 which can improve drop directionality and ease cleaning of the surface 66 or 90 compared to commercially-available photoresist laminates. In the alternative, chemical mechanical polishing, plasma, or chemicals may be applied to the surface 66 or 90 after step E to better planarize the surface, adjust the overall thickness of the material 64 or 88, and/or change its wetting characteristics of the surface 66 or 90. Accordingly, if the material 64 or 88 is applied thicker than desired for the final thickness, chemical mechanical polishing (CMP) may be used to grind the material 64 or 88 to a pre-determined thickness between steps F and G.

Spray-coating of a combined flow feature and nozzle plate layer allows for increased flexibility in overall heater to nozzle exit thickness compared to using commerically-available photoresist dry films that are sold only in select thicknesses. Spray-coating enables polymeric layers to be applied more with more precise thickness control.

If DRIE etching of the wafers 34 is conducted to form the fluid supply slots 38, all of the foregoing process steps may be conducted in a cleanroom environment. Furthermore, operator handling of wafers 34 may be reduced thereby leading to reduced scrap material and higher yields of product.

In other embodiments, passivation and/or planarization layers may be sprayed or laminated onto the surface 54, imaged, and developed between Steps A & B or between Steps B & C in FIGS. 5 or 7. Passivation and/or planarization layers may be spin-coated, laminated, or sprayed onto the surface 54, imaged, and developed between Steps A & B in FIGS. 6 or 8. Such layers may be used for only a portion of the micro-fluid ejection head structures on a wafer in order to adjust the flow feature height or floor dimensions of individual chambers or flow channels.

Moreover, in some embodiments, a barrier layer (not shown) can be deposited between Steps D & E to provide an additional solvent barrier between the mandrel 62, 72, 84, or 106 and the micro-machinable material 64 or 88, if needed. Such a barrier layer may also be used to change the fluid wetting properties of the flow feature surfaces. Althought in some embodiments the barrier layer may be photoimageable, it does not have to be (e.g., when nozzles are formed using wet or dry etching). The barrier layer may be applied by any one of a variety of techniques, such as spraying or by forming a plasma-polymerized film on the surface.

In general, the disclosed embodiments, as set forth herein, greatly improve alignment between the nozzle holes 52 and the heater resistors 36 and use less costly equipment thereby providing an advantage over conventional micro-fluid ejection head manufacturing processes.

Having described various aspects and embodiments of the disclosure and several advantages thereof, it will be recognized by those of ordinary skills that the embodiments are susceptible to various modifications, substitutions and revisions within the spirit and scope of the appended claims.

What is claimed is:

1. A method of making a micro-fluid ejection head structure, the method comprising:

applying a removable mandrel material to a semiconductor substrate wafer containing fluid ejection actuators on a device surface thereof, wherein the mandrel material is shaped to provide fluid chamber and fluid channel locations on the semiconductor substrate wafer;

applying a micro machinable material to the shaped mandrel and the device surface of the substrate wafer to provide a nozzle plate and flow feature layer on the shaped mandrel and device surface, the nozzle plate and flow feature layer having a thickness ranging from about 10 to about 80 microns;

forming a plurality of nozzle holes in the nozzle plate and flow feature layer; and removing the shaped mandrel material from the device surface of the substrate wafer to provide fluid chambers and fluid channels in the nozzle plate and flow feature layer.

2. The method of claim 1, wherein the act of applying the micro machinable material comprises dry-spraying a photoresist material in a highly volatile carrier fluid onto the device surface of the shaped mandrel material and device surface whereby the carrier fluid substantially evaporates so that the photoresist material is applied to the shaped mandrel material and device surface in solid rather than liquid form.

3. The method of claim 2, wherein the dry-spraying act comprises spray coating two or more spray-coated layers onto the shaped mandrel material and the device surface of the substrate wafer to provide the spray-coated layer.

4. The method of claim 1, wherein the nozzle plate and flow feature layer comprises a negative photoresist material.

5. The method of claim 1, wherein the mandrel material comprises a photoresist material and the mandrel material is shaped using a photo imaging and developing technique.

6. The method of claim 1, wherein the mandrel material is applied to the semiconductor substrate wafer by spin coating the mandrel material onto the device surface of the substrate wafer.

7. The method of claim 1, wherein the mandrel material is applied to the semiconductor substrate wafer using a dry film lamination technique.

8. The method of claim 1, wherein the act of forming nozzle holes in the nozzle plate and flow feature layer comprises dry etching the nozzle plate and flow feature layer.

9. The method of claim 1, wherein the act of forming nozzle holes in the nozzle plate and flow feature layer comprises a photo imaging and developing technique.

10. The method of claim 1, wherein the nozzle plate and flow feature layer comprises a composition selected from the group consisting of epoxy, acrylate, polyimide, novolac, diazonaphthaquinone, cyclized rubber, chemically amplified resists, and the like.

11. The method of claim 1, further comprising forming a plurality of fluid supply slots in the substrate wafer before applying the removable mandrel material to the wafer.

12. The method of claim 1, further comprising forming a plurality of fluid supply slots in the substrate wafer after applying the removable mandrel material to the wafer.

13. The method of claim 1, wherein the nozzle plate and flow feature layer is applied to the shaped mandrel and device surface of the substrate using a lamination technique.

14. The method of claim 1, further comprising applying at least one of a passivation layer and a planarization layer to the device surface.

15. The method of claim 1, further comprising modifying a surface of the micro machinable material by at least one of applying a chemical to the surface of the micro machinable material, applying a plasma to the surface of the micro machinable material, and grinding the surface of the micro machinable material using chemical mechanical polishing, wherein the modification can affect at least one of a planarization of the surface of the micro machinable material, a wetting characteristic of the surface of the micro machinable material, and an overall thickness of the micro machinable material.

16. A method of making a micro-fluid ejection head structure, the method comprising:

forming a plurality of fluid supply slots in a semiconductor substrate wafer having a device surface thereon;

applying a removable mandrel material to the device surface of the semiconductor substrate wafer, wherein the mandrel material is shaped to provide fluid chamber and fluid channel locations on the semiconductor substrate wafer;

dry-spraying the shaped mandrel material and the device surface of the substrate wafer with a micro machinable material in a carrier fluid to provide a spray-coated layer on the shaped mandrel and device surface of the substrate wafer, the spray-coated layer having a thickness ranging from about 10 to about 80 microns;

forming a plurality of nozzle holes in the spray-coated layer; and removing the shaped mandrel material from the device surface of the substrate wafer to provide fluid chambers and fluid channels in the spray-coated layer.

17. The method of claim 16 wherein the dry-spraying act comprises spray coating a photoresist material in a highly volatile carrier fluid onto the device surface of the substrate whereby the carrier fluid substantially evaporates so that the photoresist material is applied to the shaped mandrel material and device surface in solid rather than liquid form.

18. The method of claim 16, further comprising treating the device surface of the semiconductor substrate wafer before applying the mandrel material to increase adhesion between the mandrel material and the device surface.

* * * * *